US011198536B2

(12) United States Patent
Lombard et al.

(10) Patent No.: US 11,198,536 B2
(45) Date of Patent: Dec. 14, 2021

(54) FOOD HOLDER

(71) Applicant: BML Solutions LLC, Manhattan Beach, CA (US)

(72) Inventors: Bridgit Lombard, Manhattan Beach, CA (US); Michael Lewis, Manhattan Beach, CA (US); David Fowlkes, Jr., West Chester, PA (US)

(73) Assignee: BML Solutions LLC, Manhattan Beach, CA (US)

( * ) Notice: Subject to any disclaimer, the term of this patent is extended or adjusted under 35 U.S.C. 154(b) by 0 days.

(21) Appl. No.: 16/889,564

(22) Filed: Jun. 1, 2020

(65) Prior Publication Data

US 2020/0377257 A1 Dec. 3, 2020

Related U.S. Application Data

(60) Provisional application No. 62/855,417, filed on May 31, 2019.

(51) Int. Cl.

| | |
|---|---|
| ***B65D 5/70*** | (2006.01) |
| ***B65D 5/20*** | (2006.01) |
| ***B65D 5/42*** | (2006.01) |

(52) U.S. Cl.

CPC ..... *B65D 5/705* (2013.01); *B65D 5/2023* (2013.01); *B65D 5/2033* (2013.01); *B65D 5/2047* (2013.01); *B65D 5/4266* (2013.01)

(58) Field of Classification Search

CPC .... B65D 5/705; B65D 5/2023; B65D 5/2033; B65D 5/2047; B65D 5/3685; B65D 5/18;

(Continued)

(56) References Cited

U.S. PATENT DOCUMENTS 1,555,054 A * 9/1925 Berkowitz ..... B65D 5/3607 229/108.1
1,792,370 A * 2/1931 Goodman ..... B65D 5/36 229/108.1

(Continued)

FOREIGN PATENT DOCUMENTS

| | | |
|---|---|---|
| JP | 2003182716 A | 7/2003 |
| WO | 2008157750 | 12/2008 |
| WO | 2011144356 | 11/2011 |

OTHER PUBLICATIONS

Ricky Setiawan Sutjahya, Sushi Burrito, https://www.behance.net/gallery/13730663/Sushi-Burrito, Nov. 2015.

*Primary Examiner* — Christopher R Demeree
(74) *Attorney, Agent, or Firm* — Fitch, Even, Tabin & Flannery LLP

(57) ABSTRACT

Described herein is a food holder including a multiple-panel, tapered sleeve that may include a forward panel, a rear panel, two front-side panels and two back-side panels that for an irregular shape. The multiple-panel sleeve includes a multiple-panel bottom member connected to the bottom edges of the forward and rear panels. The bottom member includes a foldline that allows the bottom member to project upwards into a space defined by the panels when the space between the forward and rear panels is reduced. The food holder includes a tear-away portion defined by a line of perforations which may be removed by a consumer to allow access to lower portions of the food product. The irregular, tapered shape and proportionality of the bottom member promote the structural integrity of the food holder.

20 Claims, 6 Drawing Sheets

(58) Field of Classification Search
CPC ..... B65D 5/3678; B65D 75/5888; B65D 85/1048; B65D 5/36; A47G 21/001
USPC ..... 229/400, 110, 108.1, 117.01, 108, 405
See application file for complete search history.

(56) References Cited

U.S. PATENT DOCUMENTS

| | | | | |
|---|---|---|---|---|
| 2,922,562 | A * | 1/1960 | Pellaton | B65D 5/3685 229/110 |
| 3,610,512 | A | 10/1971 | Hermalin | |
| 4,915,235 | A | 4/1990 | Roosa | |
| 5,476,215 | A | 12/1995 | Baroud | |
| 6,050,482 | A | 4/2000 | Cai | |
| 6,394,338 | B1 | 5/2002 | Sluder | |
| 6,719,190 | B2 | 4/2004 | Yocum | |
| 7,140,532 | B2 | 11/2006 | Holt | |
| 7,928,349 | B2 | 4/2011 | Fitzwater | |
| 8,056,145 | B2 | 11/2011 | Shamsnobari | |
| 8,631,997 | B2 | 1/2014 | Millet | |
| 9,499,296 | B2 | 11/2016 | Mills | |
| 9,758,275 | B2 | 9/2017 | Fitzwater | |
| 2002/0129581 | A1 | 9/2002 | Correll | |
| 2003/0080120 | A1 * | 5/2003 | Whitmore | B65D 5/029 219/730 |
| 2006/0096978 | A1 | 5/2006 | Lafferty | |
| 2007/0000927 | A1 | 1/2007 | Grund | |
| 2007/0131742 | A1 * | 6/2007 | Fitzwater | B65D 75/5888 229/101.1 |
| 2010/0102110 | A1 | 4/2010 | Learn | |
| 2010/0155459 | A1 | 6/2010 | Grossman | |
| 2010/0282743 | A1 | 11/2010 | Blase | |
| 2012/0175410 | A1 | 7/2012 | Kissenpfennig | |

* cited by examiner

FOOD HOLDER

CROSS REFERENCE TO RELATED APPLICATIONS

This application claims the benefit of U.S. Provisional Application Number 62/855,417 filed May 31, 2019.

TECHNICAL FIELD

This application relates generally to food containers, and more particularly to open-ended food holders suitable for maintaining a fast-food product in a vertical position.

BACKGROUND

Numerous types of packaging are available to hold fast-food products, including containers, wraps, bags, bowls, trays, lids, cartons, clamshells, and boxes made from a variety of materials such as paper, paperboard, aluminum, cardboard, Styrofoam, other types of foam, polyethylene terephthalate, polypropylene, high-density polyethylene, low-density polyethylene, polycarbonate, and other types of plastic. While some of the available containers may protect the fast food product from external forces that may negatively affect the organoleptic properties (e.g., taste, texture, temperature, mouthfeel, etc.) of the fast food product, such as temperature or dirt, the packaging may not allow for convenient, non-messy consumption once the fast food product is removed from the container. For example, a fast-food product including a filling rolled into an edible wrap such as a flat bread like pita, naan, or tortilla (examples of which would include a burrito or a chicken wrap) or plant-based product such as lettuce or seaweed (examples of which would include lettuce wraps or sushi rolls) may be enveloped by paper or foil to protect the rolled food product until consumption. However, when these rolled food products are consumed, the rolled food product may not remain as tightly wrapped and/or may become undesirably messy to a consumer when the partially eaten, rolled food product is placed on a planar surface. When placed in a horizontal orientation, the filling in the rolled food product tends to spill out. A need remains for a food holder that allows the rolled food product to remain in a vertical position which may prevent the food product from becoming undesirably messy to a consumer. Such a food holder should further occupy the least possible volume prior to use in a fast-food establishment, by folding flat without leaving pockets of space in a stack of the flat-folded food holders. Specifically, the known packages are not capable of holding such a rolled food product in a vertical orientation and simultaneously capable of folding into a minimum-volume configuration.

One challenge of a food holder which helps the food product remain in a vertical orientation is a consumer's access to the bottom portion of the food product near the end of consumption. For example, a food holder that allows a consumer access to the bottom portion of a partially-eaten, rolled food product may not adequately support the food product in a vertical orientation or may not have enough surface area for the consumer to adequately hold the food holder. Therefore, a need exists for a food holder that will not only maintain the rolled food product in a vertical position but also allow for a consumer to eat the food product while in that same vertical orientation. This need is particularly pronounced for food products designed to be hand-held and bitten directly.

SUMMARY

Generally speaking, and pursuant to these various embodiments, a food holder is described that includes a multiple-panel sleeve configured to receive a substantially cylindrical food product and to support the substantially cylindrical food product in a vertical orientation. The multiple-panel sleeve includes a forward panel, a rear panel, two front-side panels and two back-side panels. The front-side panels are respectively joined to a first vertical edge of the forward panel and a second vertical edge of the forward panel. The back-side panels are respectively joined to the rear panel along a first vertical edge of the rear panel and a second vertical edge of the rear panel. Each front-side panel is joined to a first vertical edge of a corresponding one of the two back-side panels. The multiple-panel sleeve includes a multiple-panel bottom member connected to a bottom edge of the forward panel and a bottom edge of the rear panel. The bottom member may include a foldline that substantially bisects the bottom member and that is substantially parallel to the bottom edges of the forward panels and rear panels. The bottom member is configured to project upwards into a space defined by the forward and rear panels and the two front-side panels and the two back-side panels when a distance between the forward panel and the rear panel is reduced.

In some forms of the present disclosure, the food holder includes a tear-away portion configured to partially surround the substantially cylindrical food product when the food product is placed into the space defined by the panels. The tear-away portion may be defined by a line of perforations substantially parallel to the respective bottom edge of the two front-side panels and the two back-side panels. In some embodiments, the multiple-panel sleeve has a tapered shape. According to one form, the forward panel has a height smaller than a combined height of the height of the rear panel and a height of the tear-away portion joined to the rear panel. In some embodiments, the multiple-panel sleeve has an irregular shape such that a bottom width of the forward panel is less than a bottom width of the two front-side panels and the two back-side panels. In these embodiments, the two front-side panels and the two back-side panels are configured to contact the substantially cylindrical food product when the cylindrical food product is placed in the space defined by the panels.

DETAILED DESCRIPTION

Figure 1:
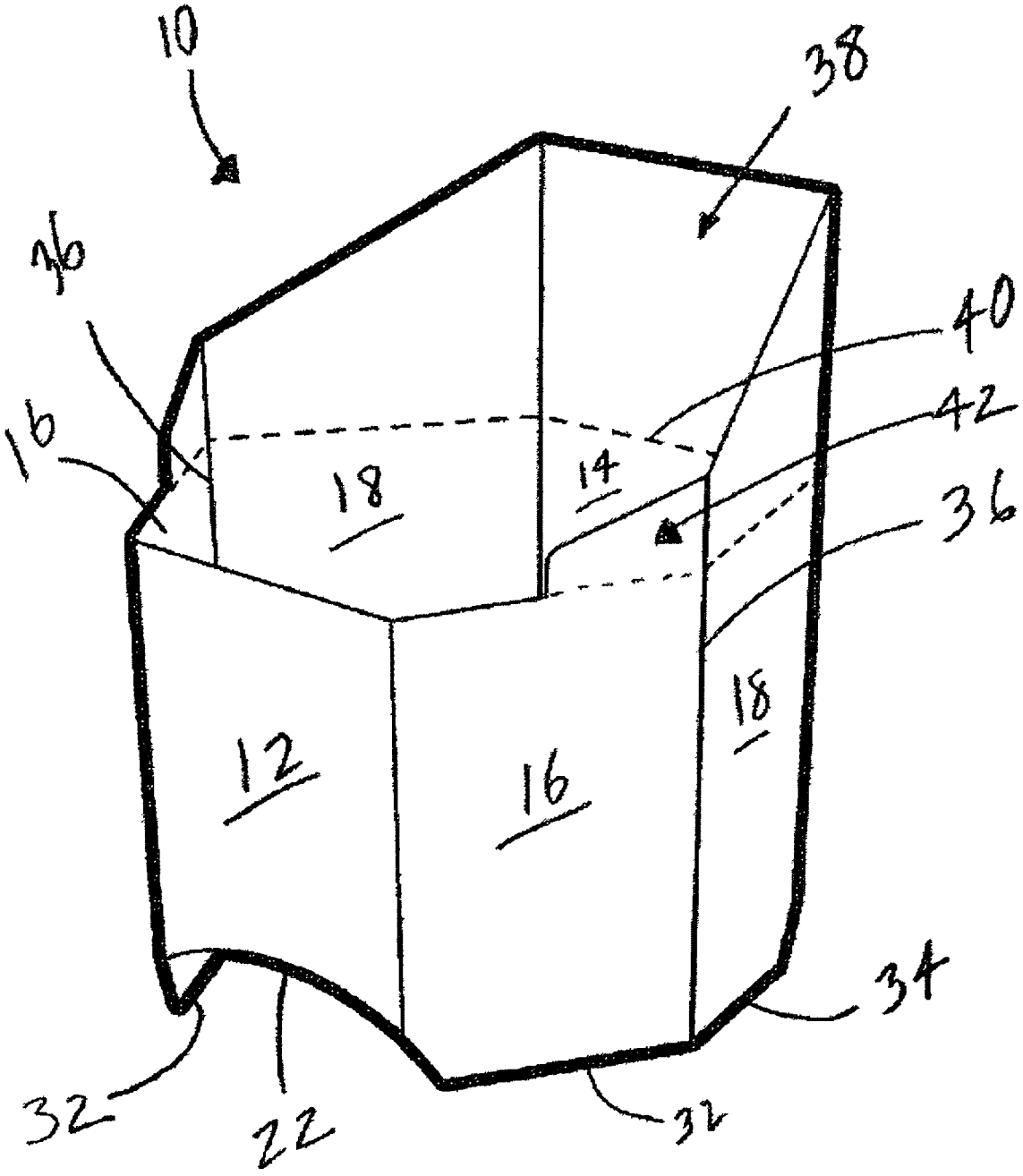
FIG. 1 is a perspective view of an example food holder in an opened, vertical position.

Described herein is a food holder 10 for receiving and supporting a substantially cylindrical food product in a vertical orientation. As will be recognized, certain food products including a filling rolled into an edible wrap such as a flat bread like pita, naan, or tortilla (examples of which would include a burrito or a chicken wrap) or plant-based product such as lettuce or seaweed (examples of which would include lettuce wraps or sushi rolls) are cylindrical in nature, although such foods may be lumpy or oval such that they are not perfectly cylindrical. Referring to FIGS. 1-5, food holder 10 includes a forward panel 12, a rear panel 14, two front-side panels 16, and two back-side panels 18. Other embodiments of the present disclosure may include a different number of panels including, but not limited to, five, seven, eight, nine, and ten.

The food holder 10 further includes a bottom member 20 pivotally coupled to a bottom edge 22 of the forward panel 12 and a bottom edge 24 of the rear panel 14. The bottom member 20 includes a foldline 26 that substantially bisects the bottom member 20 such that the bottom member has a first section 28 and a second section 30 of approximately equal area. In some embodiments of the present disclosure, the bottom member 20 may have more than one foldline 26. The bottom member 20 acts as a tension bridge connector and increases the structural integrity of the food holder 10.

Figure 2:
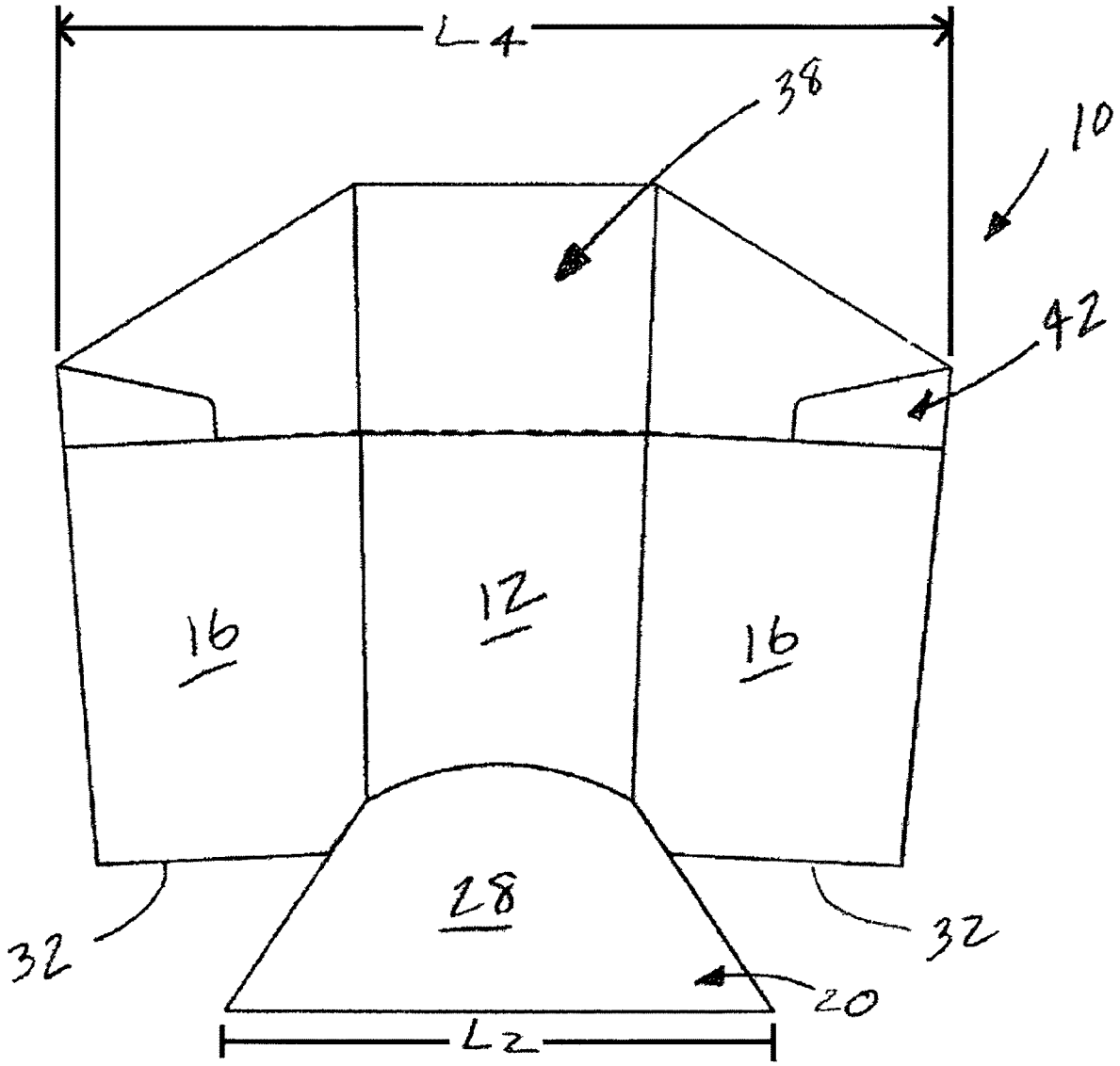
FIG. 2 is a plan view of the food holder in FIG. 1 in a flattened position.
Figure 5:
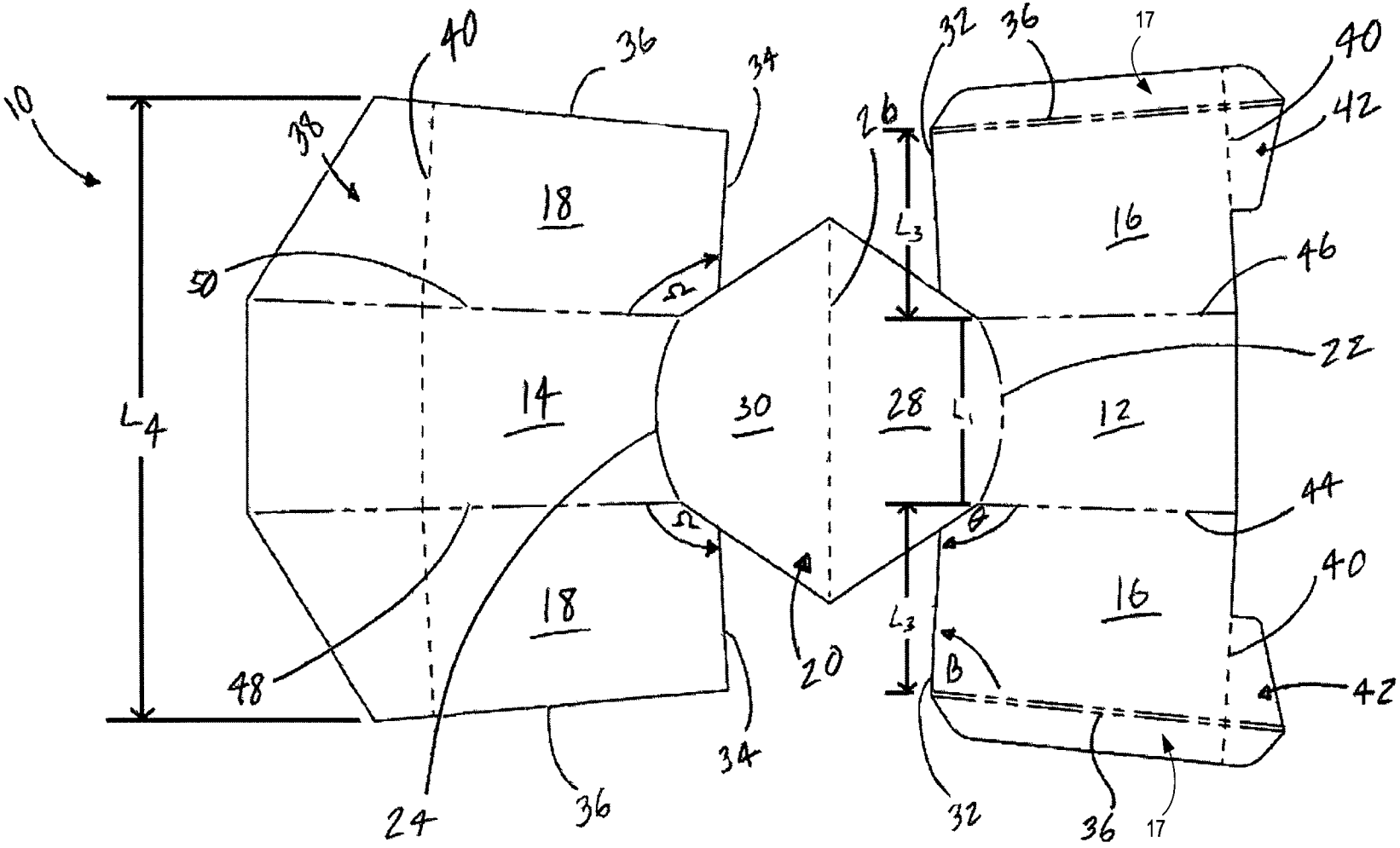
FIG. 5 is an unfolded view of a blank of the food holder in FIG. 1

In some forms of the present disclosure, the foldline 26 may divide the bottom member 20 into a first section 28 and second section 30 but not bisect the bottom member 20 resulting a first section 28 and a second section 30 that are not substantially equal in area. Arranging the folding 26 such that it does not bisect the bottom member 20 may allow the food holder 10 to fold flat when not in use, e.g., to accommodate differences in height between the bottom edge 22 and the bottom edge 24. The foldline 26 shown in FIGS. 2 and 5 is substantially parallel to the bottom edge 22 of the forward panel 12 and the bottom edge 24 of the rear panel 14 (i.e., parallel within the accuracies afforded by the materials used to form the food holder 10 and adequate to allow the food holder 10 to fold flat when not in use).

When the distance between the forward panel 12 and the rear panel 14 is reduced, for example when users squeeze those panels of the food holder using their hand, the bottom member 20 is configured to bend at the foldline 26 and project upwards into a space inside the food holder 10 between the forward panel 12, the rear panel 14, the two front-side panels 16 and the two back-side panels 18. When a food product is in the food holder 10, squeezing the food holder to reduce the distance between the forward panel 12 and the rear panel 14 causes the bottom member 20 to project into the space and therefore tends to elevate the food product in a direction away from the bottom member 20 to allow a consumer to access a lower portion of the food product. In short, by squeezing the food holder 10, the consumer causes the bottom member 20 of the food holder 10 to elevate the food product, making it possible to eat portions of the food product even if the food product itself is shorter than the two front-side panels 16 or the two back-side panels 18 of the food holder 10. In this way, the food holder 10 is adaptable to improve a consumer's access to the bottom portion of the food product near the end of consumption, allowing the consumer to eat portions of the food product that are otherwise contained in the food holder 10.

The design of the bottom member 20 is advantageous over alternative approaches. For example, one alternative would use a shutter-style bottom having separate flaps extending inward from the bottom edge of each panel, where the flaps interconnect to support the rolled food product. In this shutter-style design, the rolled food product may push the flaps outward causing them to open and may cause the food product to spill out the bottom of the food holder. In addition, the bottom surface of a food holder with a shutter-style bottom tends not to be flat and therefore may not adequately hold the rolled food product in a vertical orientation when placed on a flat surface such as a tabletop. The shutter-style design lacks the ability to adequately elevate the food product near the end of consumption. In some instances, when a consumer attempts to elevate the rolled food product by pressing the shutter-style flaps into the interior of the food folder, the flaps move away from each other to create an opening in the bottom of the food holder. Such an opening may expose the bottom of the rolled food product and allow for leakage. Further, the cost of manufacturing a shutter-style design may be greater than the cost of manufacturing the preferred, bridge design.

Figure 3:
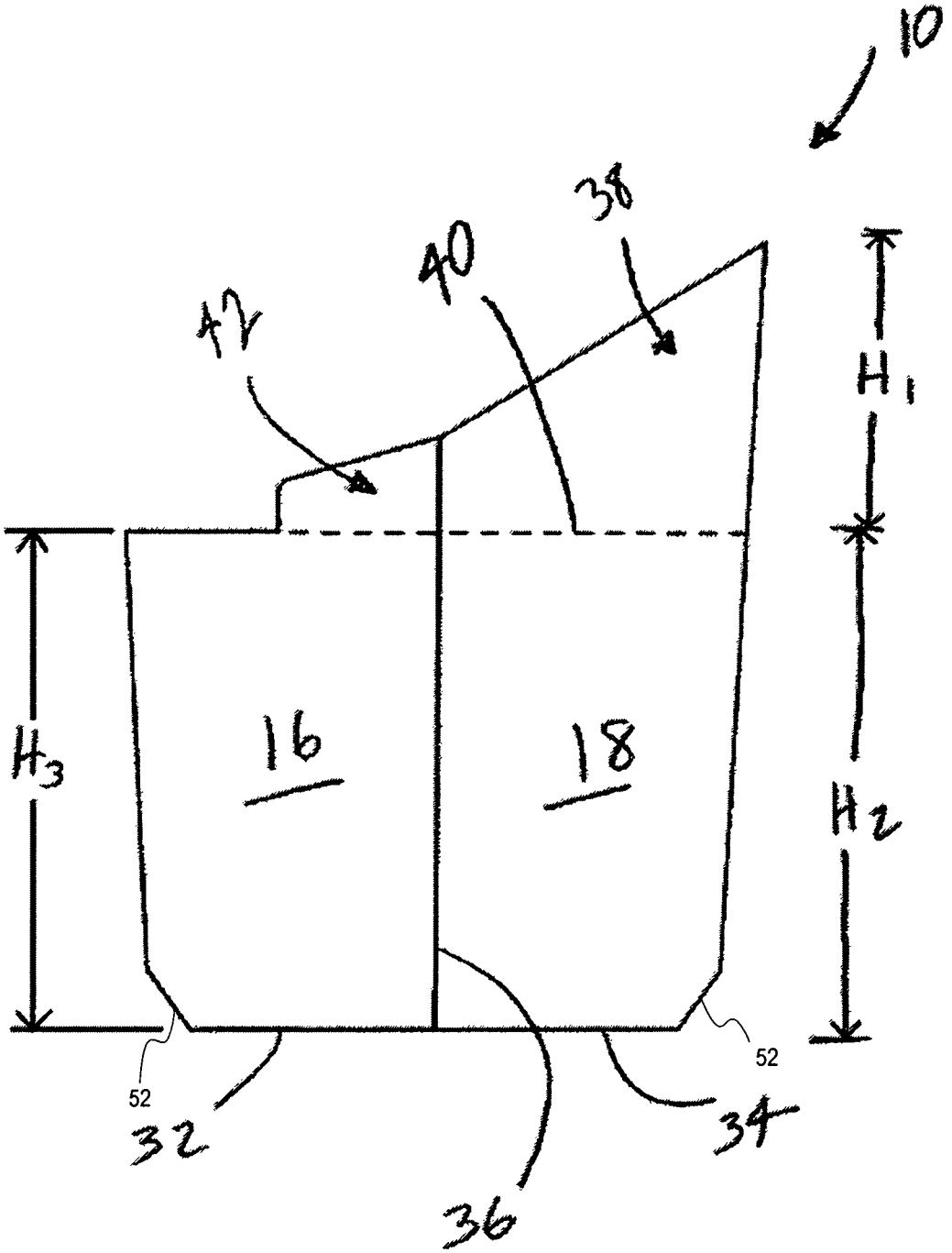
FIG. 3 is a side view of the food holder in FIG. 1.
Figure 4:
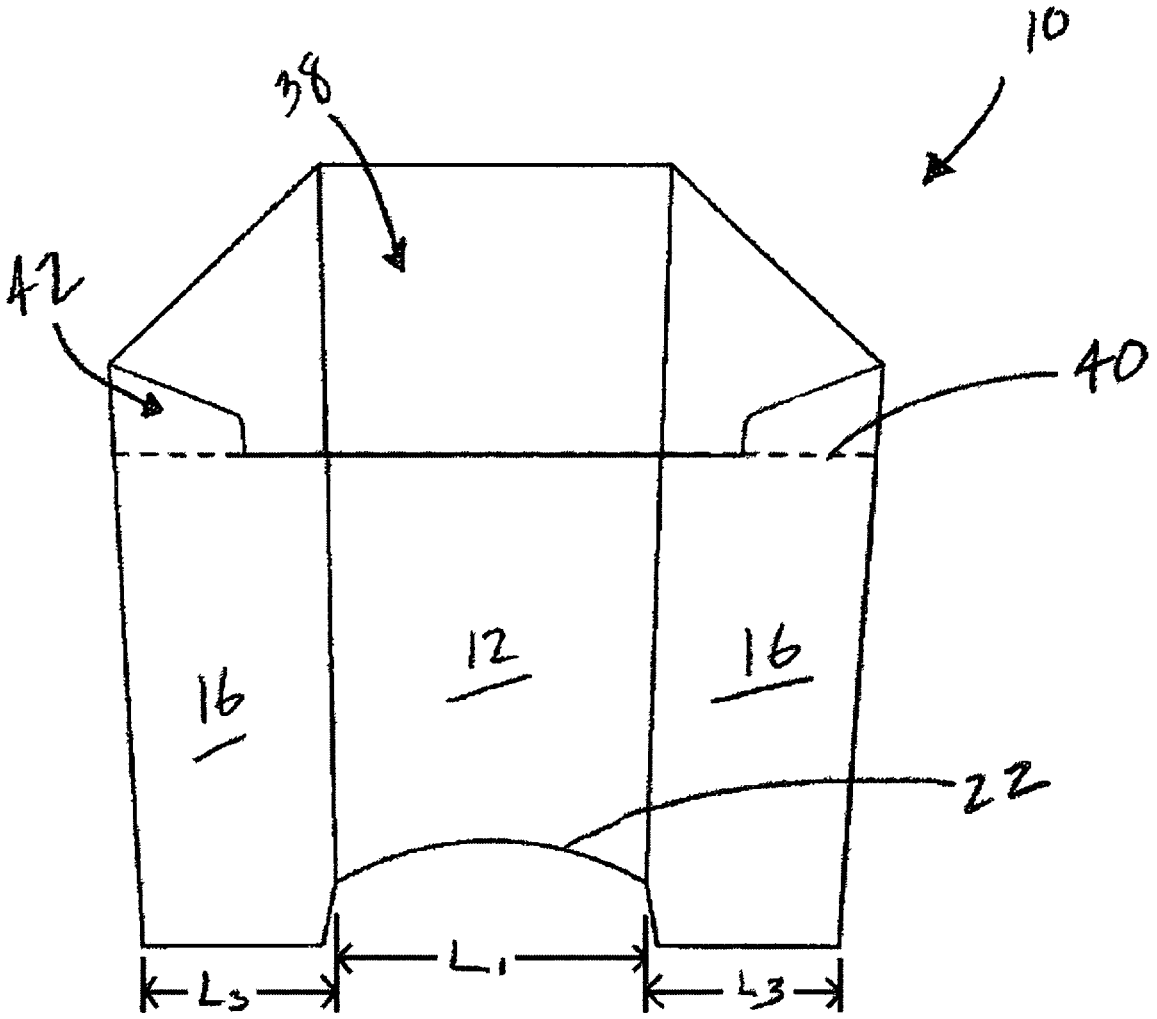
FIG. 4 is a front view of the food holder in FIG. 1.

As shown in FIGS. 1, 3, and 4, the food holder 10 may be placed in an opened, vertical position such that the forward panel 12 and rear panel 14 are as far apart as possible. In this opened, vertical orientation, a bottom edge 32 of each of the front-side panels 16 and a bottom edge 34 of each of the back-side panels 18 may contact a surface and support the food holder 10. As illustrated, these bottom edges 32, 34 are substantially perpendicular to a centerline of the food holder 10 extending upward through the bottom member 20 into the space defined by the panels 12, 14, 16, 18 (i.e., perpendicular within the accuracies afforded by the materials used to form the food holder 10 and such that when it contains a food product the food holder 10 is capable of resting on the bottom edges 32 and 34 without tipping over). When the food holder 10 is in the opened, vertical orientation, the bottom edges 32, 34 of the front-side panels 16 and back-side panels 18 extend lower than the bottom edge 22 of the forward panel 12 and the bottom edge 24 of the rear panel 14 so that bottom edges 32, 34 at least partially contact the surface. The food holder 10, therefore, contacts the surface at four points, namely, the bottom edge 32 for each of two front-side panels 16 and the bottom edge 34 for each of the two back-side panels 18. These points of contact create a plane on which the food folder 10 rests, which results in increased stability when the food product is inserted. Such increased stability can assist in preventing accidental tip-overs to the food product. In some embodiments, substantially the entire lengths of bottom edges 32, 34 may contact a surface. In other embodiments, the bottom edges 32, 34 may be curved, ridged, or scalloped such that the portions of the bottom edges 32, 34 that contact a surface still form a plane on which the food holder 10 may rest.

In some embodiments, the bottom edge 22 of the forward panel 12 and the bottom edge 24 of the rear panel 14 are curved. As shown in FIG. 5, the bottom edges 22 and 24 include a concave arcuate shape. The arcuate shape of the bottom edges 22 and 24 advantageously allows the bridge 20 to be pushed up through the vessel. Although the disclosed invention includes embodiments in which the bottom edges 22 and 24 of may be substantially straight, that approach does not similarly encourage upward movement when the front panel 12 and rear panel 14 are squeezed together. In aspects of the present disclosure where the bottom edges 22 and 24 are curved, the radius of the curve is between 1 in. and 2 in., and more preferably between about 1.25 in. and about 1.75 in. In a preferred embodiment designed for a food product with a circumference between 7 and 10.5 inches, the radius of the curve is between about 1.3 in. and about 1.6 in. The curved bottom edge 22 of the forward panel 12 and the curved bottom edge 24 of the rear panel 14 are connected to the bottom member 20. By increasing the curvature of the bottom edge 22 and the bottom edge 24, the locking operation of the bottom member 20 is improved, which better supports a rolled food product when placed in the food holder.

In one embodiment of the present disclosure, the food holder 10 is formed from a single piece of paperboard. The paperboard should have a weight (as measured per 1000 sq. ft.) of at least 80 lbs. Preferred ranges include paperboard weights between about 90 lbs. and about 185 lbs., between about 100 lbs. and about 185 lbs., between about 110 lbs. and 185 lbs., between about 120 lbs. and about 185 lbs. In an embodiment designed for a food product with a circumference between 7 and 10.5 in. and a length of less than 8 in., the preferred paperboard weight is between 130 lbs. and about 150 lbs. The preferred range ensures the paperboard is heavy enough to support food products such as the burritos available in most chain restaurants, but thin enough such that the paperboard can be bent to form the food holder. In other embodiments, the food holder may encompass more than one piece of paperboard. In other embodiments of the present disclosure, the food holder may be made from paper, synthetic paper, cardboard, corrugated paper, aluminum, other types of metal, Styrofoam, other types of foam, polyethylene terephthalate, polypropylene, high-density polyethylene, low-density polyethylene, polycarbonate, other types of plastic or another material provided at a thickness that may fold but still retains sufficient rigidity to hold the food product in a vertical orientation. The thickness of the material required to support the rolled food product in the vertical orientation of the food holder will depend on the type of material. For example, a material with a greater tensile strength or stiffness will require less thickness than a material with lesser tensile strength or stiffness to support a food product of the same weight and dimensions.

Referring to FIG. 2, the bottom width of the forward panel 12 and a bottom width of the rear panel 14 each have a length $L_1$ that is about 25% to about 75% a length of the foldline $L_2$. In the flattened position, the food holder 10 cannot stand in a vertical orientation without external support. In order to prepare the food holder 10 to receive a substantially cylindrical food product from a flattened position, pressure is applied to two first vertical edges 36 which join each of the front-side panel 16 to the back-side panel 18. The applied pressure moves the forward panel 12 and the rear panel 14 further apart from each other while simultaneously drawing the front-side panels 16 and the back-side panels 18 closer together, as well as causing the bottom member sections 28, 30 to move further apart. Additional upward pressure may be applied to the foldline 26 of the bottom member 20 such that the foldline 26 bends and the bottom member 20 projects into the space between the panels 12, 14, 16, 18. When this projection occurs, the forward panel 12 and the rear panel 14 move closer together again. Once the bottom member 20 is projected into the space between the panels 12, 14, 16, 18, pressure applied to the first vertical edges 36 prevents the bottom member 20 from returning to the flattened position without additional, sufficient downward force to the bottom member. The flattened position of the food holder 10 in FIG. 2 facilitates transportation and storage of the food holder before it is ready to use.

Figure 6:
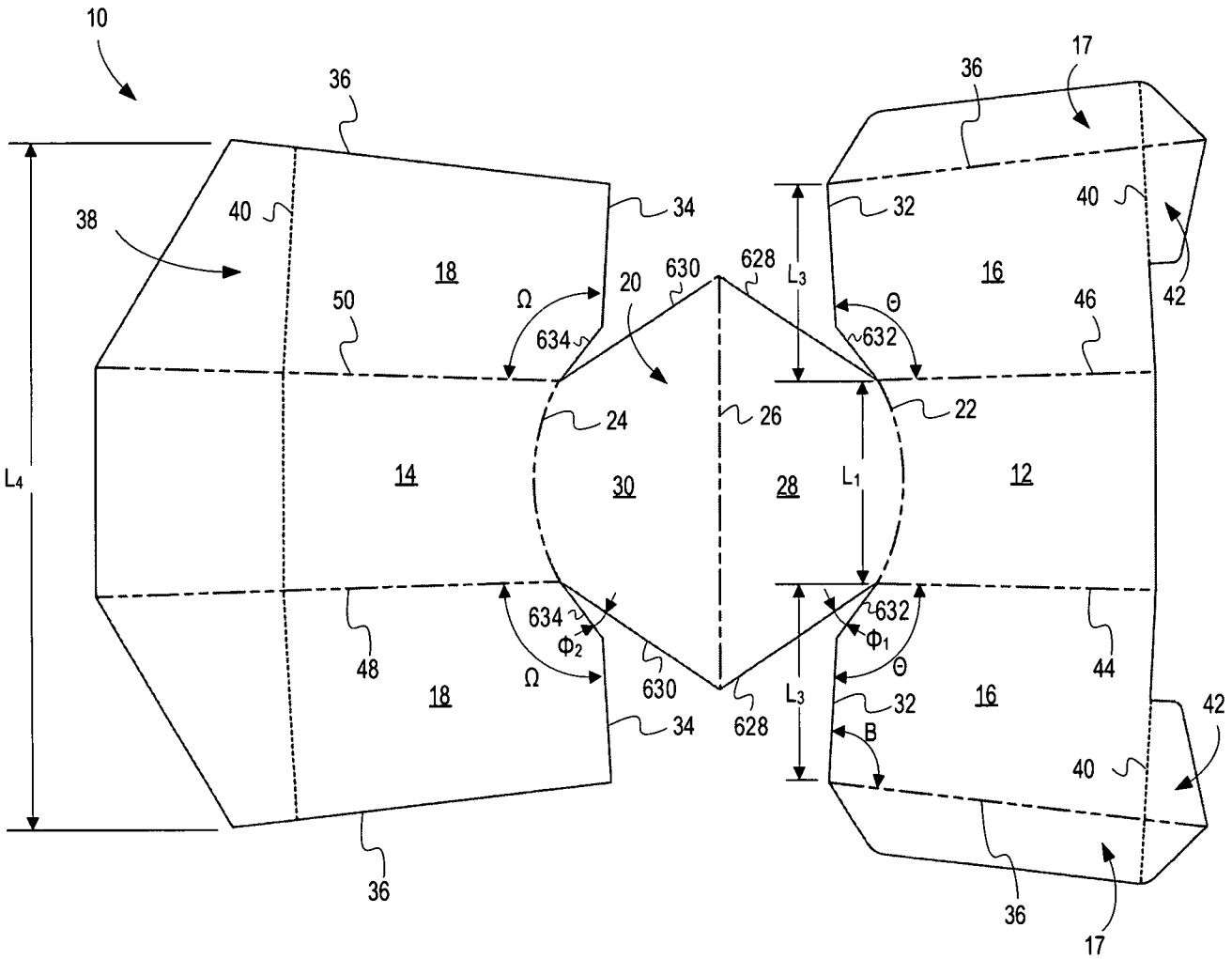
FIG. 6 illustrates an unfolded view of a blank for an alternative embodiment of the food holder.

As shown in FIGS. 1-5, the front-side panels 16 and the back-side panels 18 have angled panel corners 52, which reduces interference between the front-side panels 16 and the forward panel 12, as well as between the back-side panels 18 and the rear panel 14, when the food holder 10 transitions from a flattened position to an opened, vertical position. FIG. 6 illustrates an alternative embodiment in which the angled corner 52 is formed by stamping a different angle between the outside edges 628 and 630 of the bottom member 20 and the angled corner 52. The embodiment illustrated in FIG. 6 provides greater clearance between the bottom member and the edges of the front-side panels 16 and back-side panels 18. The angled indent between the outside edges 628 and 630 and the angled corner 52 also improves manufacturability, by allowing the food holder to be stamped using a single die-cut.

In some forms of the present disclosure, the food holder 10 also includes a tear-away portion 38. This tear-away portion 38 may partially surround the substantially cylindrical food product when the food product is inserted into to the space defined by the panels 12, 14, 16, 18. In other embodiments, the tear-away portion may completely surround the sides of the food product but remain open at the top to allow a consumer to access that top portion. Some embodiments include means to help control propagation of tearing after initiation, such as perforations or other areas of weakness. In some embodiments, the tear-away portion 38 is defined by a line of perforations 40. As shown in FIG. 3, the line of perforations 40 may be substantially parallel to the bottom edges 32 of the two front-side panels 16 and the bottom edges 34 two back-side panels 18. In other forms, the line of perforations 40 may not be substantially parallel to the bottom edges 32 of the two front-side panels 16 and to the bottom edges 34 of the two back-side panels 18. For example, the tear-away portion may be configured in a spiral pattern to reveal one side of the food product while still surrounding another side of the food product. Some embodiments of the food holder include more than one tear-away portion. A consumer may remove the tear-away portions from the rest of the food holder in stages (one at a time) as the food product is consumed or may choose to remove more than one tear-away portion at the same time to reveal a greater portion of the food product.

In some forms, the food holder 10 includes a tear-away portion 38 that is coupled to three, four, five, six, seven, or eight panels; half the panels; less than half the panels; or greater than half the panels. In one embodiment, the tear-away portion has a substantially uniform height. In other embodiments, the height of the tear-away portion varies from one panel to another. This configuration is beneficial because it supports the cylindrical food product in the horizontal orientation (i.e., taller panels of the tear-away portion lie underneath the food product) but allow access for a consumer to consume the cylindrical food product.

Preferably, as seen in FIGS. 1-5, the height of the tear-away portion 38 tapers from one panel to the next and does not traverse the entire width of a front-side panels 16. As shown, the tear-way portion 38 of the food holder 10 includes at least one tab 42 to facilitate the removal of the tear-away portion 38. The tab 42 forms a small strip of material with enough area such that a consumer can securely grasp the tab 42 to initiate the tear to remove the tear-away portion 38. In one form, the tab 42 has rounded corners instead of the straight edges shown. In some examples the food holder 10 includes an attachment means such as perforations for securing the tabs 42 to the corresponding one of the two front-side panels 16. In some embodiments, the tab may not be connected to the panel underneath the tab but only to the tear-away portion directly adjacent to the tab. In some embodiments, notches or edge cuts are provided as a means to facilitate tear initiation. In embodiments where a tab or the like is used, the tab may be of the same material as the rest of the food holder or of a different material.

In some embodiments, the tear-away portion includes a plurality of securing tabs extending from different positions at the top of the tear-away portion 38 toward the centerline of the food holder, such that each of the plurality of securing tabs assists in stabilizing the food product within the food holder. In some forms, the plurality of securing tabs is equal to the number of panels. In other forms, the plurality of securing tabs is less than the number of panels. In yet other forms, the plurality of securing tabs is greater than the number of panels. In some embodiments which do not include a tear-away portion 38, the securing tabs may extend directly from the panels.

Referring to FIG. 3, a height $H_1$ of the tear-away portion 38 joined to the rear panel 14 is at least 40% of a height $H_2$ of the rear panel 14. In other embodiments, the total height of the tear-away portion(s) may be at least 10%, at least 20%, at least 30%, at least 50%, at least 60%, at least 70%, at least 80%, or at least 90% of the height of the rear panel. The specific ratio between $H_1$ and $H_2$ will depend on the length of the food product, which is preferably not be more than double the combined $H_1$ and $H_2$ height. If the food is substantially more than double the combined $H_1$ and $H_2$ height, the food product tends to slump or fall over when placed in a vertical orientation because the weight of the food product needs to be distributed and supported by the food holder. The combined heights $H_1$ and $H_2$ will preferably be above the median height of the food product. The preferred embodiment illustrated in FIG. 3 is designed based on food products with lengths less than 8 in. In some forms of the present disclosure, the forward panel 12 may have a height $H_3$ smaller than the combined height of the height $H_1$ and $H_2$. In other embodiments, the height $H_3$ may be equal to the combined height of $H_1$ and $H_2$. Preferably, as shown in FIG. 3, the height $H_3$ of the forward panel 12 is substantially similar to that of the height $H_2$ of the rear panel 14 to facilitate eating the food product when the tear-away portion 38 is removed. In other aspects, the height $H_3$ of the forward panel 12 is less than the height $H_2$ of the rear panel 14.

As illustrated in FIGS. 4 and 5, the food holder 10 may be an irregular shape such that a bottom width $L_1$ of the forward panel 12 is less than a bottom width $L_3$ of the two front-side panels 16 and the two back-side panels 18. In such an embodiment, the two front-side panels 16 and the two back-side panels 18 may be configured to contact the food product when the food product is placed in the space defined by panels 12, 14, 16, 18. By increasing the width $L_3$ of the front-side panels 16 and 18 relative to the width $L_1$ of the forward panel 12 and rear panel 14, the food holder better serves to lock the bottom member 20 in place upon expanding the food holder to receive a cylindrical food product.

As shown in FIG. 5, the food holder 10 may have a tapered shape where an angle θ of between about 90 and about 95 degrees is formed between the bottom edges 32 of the front-side panels 16 and a respective first vertical edge 44 and second vertical edge 46 of the forward panel 12. The tapered shape may include an angle Ω of between about 90 and about 95 degrees formed between the bottom edges 34 of the back-side panels 18 and a respective first vertical edge 48 and second vertical edge 50 of the rear panel 14. In some embodiments, the tapered shape includes an angle β of between about 90 and about 95 degrees formed between the bottom edges 32 of the front-side panels 16 and the respective vertical edges 36 joining the front-side panels 16 to the two back-side panels 18.

The tapered, irregular shape of the food holder helps to provide rigidity to the food holder when a product resides in the space between the panels such that the food holder tends to remain in the vertical orientation and that the bottom member supports the food product within the space between the panels. Specifically, the taper of the food holder provides increased structural integrity when the food product inserted into the food holder. The weight of the food product provides increased inward pressure on the panels and prevents the bottom member being pushed back outside the space between the panels. Further, by selecting lengths for the forward panel and the rear panel relative to the lengths of the front-side and back-side panels, the front-side panels and the back-side panels substantially contact and support the food product. In embodiments with sufficient taper to help support the food product, securing tabs may not be necessary to stabilize the food product within the food holder. Removing the securing tabs is an advantage of the tapered shape, because the securing tabs may cause resistance against the rolled food product when the food product is elevated out of the food holder by the bottom member.

The food holder may have varying sizes to conform to varying sizes of cylindrical food products, for example, a smaller burrito to be consumed by a child and a regular burrito to be consumed by an adult. When in an opened, vertical position, the height of rear panel 14 of the food holder 10 combined with any tear-away portions 38 above the rear panel, as a percentage of the length of the rolled food product, may be between about 30% and about 100%, between about 35% and about 100%, between about 40% and about 100%, between about 45% and about 100%, between about 50% and about 100%, between about 55% and about 100%, between about 60% and about 100%, between about 65% and about 100%, between about 70% and about 100%, between about 75% and about 100%, between about 50% and about 75%, between about 50% and about 70%, between about 50% and about 65%, between about 50% and about 60% or, preferably, about 65% to about 70% the length of the rolled food product. As noted above, if the food is substantially more than double the combined $H_1$ and $H_2$ height shown in FIG. 3, the food product tends to slump or fall over when placed in a vertical orientation. Such a proportionality allows a consumer access to the rolled food product while still providing adequate support to keep the food product in a vertical position.

When in a flattened position, the food holder 10 may have a total width $L_4$ of between about 3 in. and 6 in., between about 3.5 in. and about 5.5 in., between about 4 in. and about 5.5 in., between about 4.5 in. and about 5.5 in., and preferably between about 4.8 in. and about 5.3 in. In some embodiments, the length $L_2$ of the foldline 26, as a percentage of the total width $L_4$ of the food holder 10, may be between about 55% to about 65% or about 60%, which may assist in increasing the structural integrity of the food holder 10.

FIG. 6 illustrates an alternative embodiment of the invention, which shares many features with the embodiment illustrated in FIGS. 1-5. Reference numerals shared between FIG. 6 and FIGS. 1-5 correspond to features discussed above. FIG. 6 illustrates an angle $\Phi_1$ between outside edges 628 of the bottom member 20 and the tapered portion 632 of the bottom edge 32 of front-side panels 16. Similarly, an angle $\Phi_2$ exists between outside edges 630 of the bottom member 20 and the tapered portion 634 of the bottom edge 34 of front-side panels 18. The angles $\Phi_1$ and $\Phi_2$ make it easier to open the food holder with one hand. Without the angled relief, the edges 628 and 632 and the edges 630 and 634 tend to stick together, which generally prevents the food holder from expanding from a collapsed position (as shown in FIG. 2) to an open position (as shown in FIG. 1). The angles $\Phi_1$ and $\Phi_2$ may be substantially identical, or they may differ to accommodate asymmetry in the bottom member 20. As shown in FIG. 6, angles $\Phi_1$ and $\Phi_2$ may be between about 15 and about 30 degrees and preferably will be between 20 and 25 degrees. Smaller angles for $\Phi_1$ and $\Phi_2$ may make tooling more complicated and may reduce the effectiveness of including the angled relief. Larger angles for $\Phi_1$ and $\Phi_2$ may make the food holder less stable by reducing the footprint formed by the edges 32 and 34.

Each of the various features described above may be used in combination with any other compatible features described above. Various aspects of the article described herein are further described in the following claims.

What is claimed is:

1. A multiple-panel sleeve configured to receive a substantially cylindrical food product and to support the substantially cylindrical food product in a vertical orientation, the multiple-panel sleeve comprising:

a forward panel, a rear panel, two front-side panels, and two back-side panels forming an open-top space configured to receive the food product;

wherein the front-side panels are respectively joined to a first vertical edge of the forward panel and a second vertical edge of the forward panel;

wherein the back-side panels are respectively joined to the rear panel along a first vertical edge of the rear panel and a second vertical edge of the rear panel;

wherein each front-side panel is joined to a first vertical edge of a corresponding one of the two back-side panels;

a bottom member connected to a bottom edge of the forward panel and a bottom edge of the rear panel;

wherein part of the rear panel and the two back-side panels forms a tear-away portion, wherein the tear-away portion is configured to at least partially surround the substantially cylindrical food product when the food product is placed in the open-top space defined by the panels.

2. The multiple-panel sleeve of claim 1 wherein the bottom edge of the forward panel and the bottom edge of the rear panel include a concave arcuate shape.

3. The multiple-panel sleeve of claim 1 wherein the bottom member has a foldline that substantially bisects the bottom member and is substantially parallel to the bottom edges of the forward and rear panels, wherein the bottom member is configured to project upwards into a space defined by the forward and rear panels and the two front-side panels and the two back-side panels when a distance between the forward panel and the rear panel is reduced.

4. The multiple-panel sleeve of claim 3 wherein the two front-side panels and the two back-side panels include a bottom edge substantially perpendicular to a centerline extending upward from the bottom member through the space defined by the forward and rear panels and the two front-side panels and the two back-side panels, and wherein the bottom edge of the respective front-side and back-side panels extends beneath the respective bottom edge of the forward panel and rear panel.

5. The multiple-panel sleeve of claim 4 wherein a bottom width of the forward panel has a length of about 25% to about 75% a length of the foldline of the bottom member.

6. The multiple-panel sleeve of claim 4 wherein the sleeve has a tapered shape wherein an angle of between 90 and 95 degrees is formed between the respective bottom edge of the two front-side panels and the respective first vertical edge and the second vertical edge of the forward panel, wherein an angle of between 90 and 95 degrees is formed between the respective bottom edge of the two back-side panels and the respective first vertical edge and second vertical edge of the rear panel, and wherein an angle of between 90 and 95 degrees is formed between the respective bottom edge of the two front-side panels and the respective first vertical edge of the corresponding one of the two back-side panels.

7. The multiple-panel sleeve of claim 3 wherein the tear-away portion further comprises part of the two front-side panels but not the front panel, and wherein the tear-away portion is defined by a line of perforations substantially parallel to the respective bottom edge of the two front-side panels and the two back-side panels.

8. The multiple-panel sleeve of claim 7 wherein a section of the tear-away portion joined to the rear panel is at least 40% of a height of the rear panel.

9. The multiple-panel sleeve of claim 8 wherein the forward panel has a height smaller than a combined height of the height of the rear panel and a height of the tear-away portion joined to the rear panel.

10. The multiple-panel sleeve of claim 8 wherein the forward panel has a height substantially equivalent to the height of the rear panel.

11. The multiple-panel sleeve of claim 3 wherein the line of perforations defining the tear-away portion form a spiral around the sleeve.

12. The multiple-panel sleeve of claim 1 wherein the sleeve is formed from a single sheet of paperboard stock.

13. The multiple-panel sleeve of claim 12 wherein the paperboard stock has a weight of at least 80 lbs. per 1,000 square feet.

14. The multiple-panel sleeve of claim 12 wherein:

a bottom edge of the front-side panel includes a tapered portion corresponding to a first edge of the bottom member; and a bottom edge of the back-side panel includes a tapered portion corresponding to a second edge of the bottom member.

15. The multiple-panel sleeve of claim 14 further comprising:

a first angled relief between the tapered portion of the bottom edge of the front-side panel and the first edge of the bottom member; and a second angled relief between the tapered portion of the bottom edge of the back-side panel and the second edge of the bottom member.

16. The multiple-panel sleeve of claim 1 further comprising tabs that extend from a respective first vertical edge of each of the two back-side panels and an attachment means for securing the tabs to a corresponding one of the two front-side panels.

17. The multiple-panel sleeve of claim 1 further comprising tabs that extend from a respective first vertical edge of each of the two front-side panels and an attachment means for securing the tabs to a corresponding one of the two back-side panels.

18. The multiple-panel sleeve of claim 1 further comprising an irregular hexagonal shape wherein a bottom width of the forward panel is less than a bottom width of each of the two front-side panels and the bottom width of the forward panel is less than a bottom width of each of two back-side panels; and wherein the two front-side panels and the two back-side panels are configured to contact the substantially cylindrical food product when the cylindrical food product is placed in the space defined by the panels.

19. A multiple-panel sleeve configured to receive a substantially cylindrical food product, the multiple-panel sleeve comprising:

a forward panel having a width;

a rear panel having a width;

two front-side panels, each front-side panel having a width greater than the width of the forward panel, wherein each front-side panel is foldably joined at a respective first vertical edge of the forward panel;

two back-side panels, each back-side panel having a width greater than the width of the rear panel, wherein each back-side panel is foldably joined at a respective first vertical edge of the rear panel;

wherein each front-side panel is foldably joined to a vertical edge of a corresponding one of the two back-side panels;

wherein the forward panel, rear panel, two front-side panels, and two back-side panels form an irregular hexagonal space configured to receive the food product;

a bottom member foldably connected to a bottom edge of the forward panel and foldably connected to a bottom edge of the rear panel;

a line of perforations defining a tear-away portion of the rear panel and the two back-side panels, wherein the line of perforations crosses portions of the front-side panels, the back-side panels and the rear panel only.

20. The multiple-panel sleeve of claim 19 further comprising:

a foldline that substantially bisects the bottom member and is substantially parallel to the bottom edges of the forward and rear panels, wherein the bottom member is configured to project upwards into the hexagonal space defined by the forward panel, rear panel, two front-side panels, and two back-side panels when the forward panel and the rear panel are pressed toward one another.

* * * * *